US008887995B2

(12) United States Patent
Seibert

(10) Patent No.: US 8,887,995 B2
(45) Date of Patent: Nov. 18, 2014

(54) DEVICE FOR HANDLING VALUE NOTES AND CASH BOX FOR RECEIVING VALUE NOTES

(75) Inventor: Joachim Seibert, Brilon (DE)

(73) Assignee: Wincor Nixdorf International GmbH (DE)

( * ) Notice: Subject to any disclaimer, the term of this patent is extended or adjusted under 35 U.S.C. 154(b) by 306 days.

(21) Appl. No.: 13/498,103

(22) PCT Filed: Aug. 27, 2010

(86) PCT No.: PCT/EP2010/062531

§ 371 (c)(1),
(2), (4) Date: Mar. 23, 2012

(87) PCT Pub. No.: WO2011/036025

PCT Pub. Date: Mar. 31, 2011

(65) Prior Publication Data

US 2012/0276881 A1 Nov. 1, 2012

(30) Foreign Application Priority Data

Sep. 25, 2009 (DE) ..... 10 2009 043 093

(51) Int. Cl.
*G07F 19/00* (2006.01)
*G07D 11/00* (2006.01)

(52) U.S. Cl.
CPC ..... *G07D 11/0066* (2013.01); *G07F 19/20* (2013.01); *G07D 11/0006* (2013.01); *Y10S 902/08* (2013.01); *Y10S 902/09* (2013.01); *Y10S 902/13* (2013.01); *Y10S 902/17* (2013.01); *Y10S 902/21* (2013.01)
USPC ..... 235/379; 902/8; 902/9; 902/13; 902/17; 902/21

(58) Field of Classification Search
CPC ..... G07F 19/202; G07F 19/20; G07F 19/209; G07D 11/0006; G07D 11/0009; G07D 11/0012; G07D 11/0021; G07D 11/0045; G07D 11/0054; G07D 11/0057; G07D 11/0072; G07D 11/0075; G07D 11/0084
USPC ..... 235/379; 902/1–22
See application file for complete search history.

(56) References Cited

U.S. PATENT DOCUMENTS 5,012,075 A 4/1991 Hutchison et al.
7,341,179 B2 * 3/2008 Tocher et al. ..... 235/379

(Continued)

FOREIGN PATENT DOCUMENTS

DE 690 04 906 T2 7/1994
DE 19932149 A1 1/2001

(Continued)

OTHER PUBLICATIONS

International Search Report (in English) and Written Opinion (in German) for PCT/EP2010/062531, mailed Jan. 21, 2011; ISA/EP.

(Continued)

*Primary Examiner* — Kristy A Haupt
(74) *Attorney, Agent, or Firm* — Harness, Dickey & Pierce, P.L.C.

(57) ABSTRACT

The invention relates to a device (10, 50, 60, 200) for handling notes of value. The device (10, 50, 60, 200) comprises a radio unit (20) for sending data from the device (10, 50, 60, 200) to a service unit (22) via mobile radio (24). Further, the device (10, 50, 60, 200) has a safe (12, 202) in which at least one cash cassette (14*a*, 14*b*, 100, 204*a*, 204*b*) is accommodated. The cash cassette (14*a*, 14*b*, 100, 204*a*, 204*b*) comprises an authentication data memory (18*a*, 18*b*, 106, 208*a*, 208*b*) in which authentication data for the unambiguous authentication of the cash cassette (14*a*, 14*b*, 100, 204*a*, 204*b*) by the service unit (22) are stored. The radio unit (20) transmits the authentication data and stock data with information on the current stock of notes of value in the cash cassette (14*a*, 14*b*, 100, 204*a*, 204*b*) to the service unit (22) via mobile radio (24). A further aspect of the invention relates to a cash cassette (100, 204*a*, 204*b*) for holding notes of value.

20 Claims, 5 Drawing Sheets

(56) References Cited

U.S. PATENT DOCUMENTS

| | | | | |
|---|---|---|---|---|
| 7,395,766 | B2 | 7/2008 | Landwehr et al. | |
| 7,428,873 | B1 | 9/2008 | Searle et al. | |
| 7,433,848 | B1 | 10/2008 | Albrecht et al. | |
| 2004/0046015 | A1 | 3/2004 | Skinner | |
| 2008/0061127 | A1* | 3/2008 | Brexel | 235/379 |
| 2008/0102680 | A1* | 5/2008 | Chang et al. | 439/326 |
| 2009/0265276 | A1 | 10/2009 | Jordan | |
| 2010/0012718 | A1* | 1/2010 | Griswold et al. | 235/379 |
| 2010/0117844 | A1 | 5/2010 | Brexel et al. | |
| 2010/0146264 | A1 | 6/2010 | Blume et al. | |
| 2010/0213023 | A1 | 8/2010 | Freitag et al. | |
| 2010/0310069 | A1 | 12/2010 | Krummel et al. | |
| 2011/0056415 | A1 | 3/2011 | Moog et al. | |
| 2011/0101013 | A1 | 5/2011 | Berendes | |
| 2011/0181416 | A1 | 7/2011 | Dietz et al. | |
| 2012/0032391 | A1 | 2/2012 | Holland-Letz et al. | |

FOREIGN PATENT DOCUMENTS

| | | | |
|---|---|---|---|
| DE | 20001117 | U1 | 6/2001 |
| DE | 69814924 | T2 | 2/2004 |
| DE | 102004061467 | A | 6/2006 |
| DE | 102006054484 | A | 5/2008 |
| DE | 102007014176 | A | 8/2008 |
| EP | 0712099 | A1 | 5/1996 |
| WO | WO-0154084 | A1 | 7/2001 |
| WO | WO-2007/014803 | A1 | 2/2007 |

OTHER PUBLICATIONS

International Preliminary Report on Patentability (Chapter I of the Patent Cooperation Treaty) in English for PCT/EP2010/062531, issued Apr. 3, 2012.

* cited by examiner

DEVICE FOR HANDLING VALUE NOTES AND CASH BOX FOR RECEIVING VALUE NOTES

CROSS-REFERENCE TO RELATED APPLICATIONS

This application is a National Stage of International Application No. PCT/EP2010/062531, filed Aug. 27, 2010, and published in German as WO 2011/036025 A1 on Mar. 31, 2011. This application claims the benefit and priority of German Application 10 2009 043 093.8, filed Sep. 25, 2009. The entire disclosures of the above applications are incorporated herein by reference.

BACKGROUND

This section provides background information related to the present disclosure which is not necessarily prior art.

TECHNICAL FIELD

The invention relates to a device for handling notes of value, comprising a safe for accommodating cash cassettes, wherein at least one cash cassette is accommodated in the safe. A further aspect of the invention relates to a cash cassette for holding notes of value.

DISCUSSION

The device is in particular an automated teller machine, an automatic cash register system or an automatic cash safe. The cash cassettes accommodated in the automated teller machine, the automatic cash register system and/or the automatic cash safe have to be emptied in time before their maximum possible filling level is reached or, respectively, filled in time before the cash cassette is completely emptied. In general, this is carried out by a service provider, in particular a valuable transport company, who usually does not belong to the organization of the operator of the automated teller machine, the automatic cash register system or the automatic cash safe. In a closed money circuit, a so-called cash cycle management of the second order, the cash cassettes are exchanged directly between deposit-oriented devices and withdrawal-oriented devices without the cash cassettes first being brought to a cash center of the valuable transport company serving as a head quarter in order to be emptied or, respectively, to be filled thereat. To guarantee the smooth running of such a closed money circuit, it is necessary that the cash cassettes are filled or, respectively, emptied in time in a reliable manner. Up to now, it was common practice that the cash cassettes were emptied or, respectively, filled at fixed points in time which were agreed upon between the operator of the device and the service provider. This has the disadvantage that, in order to prevent that a full cash cassette is not emptied in time or, respectively, an empty cash cassette is not filled in time, it is necessary to keep the time intervals between the emptying or, respectively, filling events very short. Therefore, the cash cassettes are usually filled or, respectively, emptied before this is actually necessary. This in turn results in that the cash cassettes are altogether emptied or, respectively, filled more often than necessary so that unnecessarily high costs are incurred.

The automated teller machines, the automatic cash safes and/or the automatic cash register systems are generally integrated into a computer network of the operator, with which a large number of automated teller machines, automatic cash register systems and/or automatic cash safes are connected and via which the operator can transfer data with information on the status of the devices, in particular the filling level of the cash cassettes, and can monitor the device. Therefore, one option to prevent an unnecessary emptying or, respectively, filling of the cash cassettes as a result of firmly agreed dates is that the operator of the device informs the service provider by phone, facsimile or e-mail when a cash cassette is to be filled or, respectively, emptied. This has the disadvantage that in this way high expenses are incurred for the operator of the device.

A further option is to provide the service provider with access to the computer network of the operator, as a result whereof the service provider himself can monitor the filling level of the individual cash cassettes and can empty or, respectively, fill the cash cassettes in time. What is problematic here is that via the computer networks of the operators, in particular in the case of banks, access to confidential data to which the service provider must not have any access is possible. One possibility of preventing this is the use of complex firewall systems by which it is guaranteed that the service provider is only granted access to information which he needs for filling and emptying the cash cassettes. The use of such firewall systems has the disadvantage that high costs are incurred in this way for the operator. The service providers are generally not only in charge of the automated teller machines, the automatic cash register systems and/or automatic cash safes of one operator but of a large number of operators. Therefore, the use of firewall systems has the disadvantage for the service provider that for each operator the service provider has to adapt to a different network structure, as a result whereof high expenses and high costs are incurred for the service provider.

From the document WO 2007/014803 A1, a system for the input and output of notes of value is known. A transfer unit which comprises a value note transport device and a value note storage device and can be connected to various system devices is provided, into which the banknotes can be input, stored, and can again be output.

From the document DE 10 2007 014 176 A1, a system and a method for handling cash logistic processes are known. The system comprises cash cassettes for the deposit and/or the withdrawal of banknotes and transport means for the transport of the cash cassettes from and to automated teller machines.

From the document DE 10 2006 054 484 A1, a method for the interaction of a bank customer with an automated teller machine is known, in which instead of the usual display device and the keypad of a conventional automated teller machine the communication between the automated teller machine and the bank customer takes place via a mobile phone of the bank customer.

SUMMARY OF THE INVENTION

It is an object of the invention to specify a device for handling notes of value and a cash cassette, which enable a demand-oriented and demand-actuated supply with notes of value as well as removal of notes of value without access to a computer network of the operator of the device being necessary.

By providing a radio unit for sending data from the device to a service unit of the service provider via mobile radio and the transmission of stock data with information on the current stock of notes of value in the cash cassette by means of this radio unit from the device to the service unit it is achieved that the stock data can be transmitted to the service unit without the service unit having to have access to the computer network of the operator of the device. By transmitting the stock data with information on the current stock in the cash cassette to the service unit it is guaranteed that the service provider can empty or, respectively, fill the cash cassette before the cash cassette is completely filled or, respectively, completely emptied.

By providing an authentication data memory in the cash cassette in which authentication data for the unambiguous authentication of the cash cassette by the service unit are stored, it is guaranteed that the cash cassette can be unambiguously identified and authenticated by the service unit so that the necessary security is guaranteed. The identification of the cash cassette can, for example, take place by means of a cash cassette number that is individual for each cash cassette. For identification of the cash cassette at the service unit, in addition to the cash cassette number, for example, a PIN and/or a password, in particular a one-time password are transmitted.

The cash cassette in particular comprises a stock data memory in which at least the current stock of notes of value in the cash cassette is stored. Preferably, the serial number, the order, the denomination and the currency of all notes of value held in the cash cassette are stored in the stock data memory. In this way, the cash cassettes can be exchanged between different devices without a revision during which all notes of value are taken from the cash cassette and the cash cassettes are newly loaded having to be carried out first. This makes a closed money circuit without cash center possible, as a result whereof costs and expenses are saved. The stock data are in particular determined in that the current stock is read out from the stock data memory. Alternatively or additionally, the cash cassette can also comprise a stock sensor for determining the current stock of notes of value in the cash cassette.

It is advantageous when a control unit compares the current stock of notes of value with an upper limit value and/or a lower limit value and when the radio unit transmits the stock data to the service unit when the current stock exceeds the upper limit value or the current stock falls below the lower limit value. In this way, it is achieved that the stock data are sent to the service unit before the cash cassette is completely filled or, respectively, completely emptied. The limit values are in particular chosen such that the service provider in charge of filling and emptying the cash cassette has sufficient time to empty or, respectively, fill the cash cassette so that there are no down times of the device. The control unit is in particular a central control unit of the device which reads out the stock data of all cash cassettes accommodated in the device from the respective stock data memories of the cash cassettes and compares them to the upper and lower limit values. Here, the limit values may be set differently from cash cassette to cash cassette. Alternatively, each cash cassette can also comprise its own control unit which compares the current stock to the limit values. In this way, it is achieved that the cash cassettes can manage their stock by themselves independently of the device.

In a preferred embodiment of the invention, the cash cassette comprises a subscriber identity module (SIM) with a memory area in which the stock data and/or the authentication data are stored. The SIM in particular comprises the authentication data memory and the stock data memory. The use of a SIM as an authentication data memory and/or stock data memory is advantageous since the SIM is required for the dial-up into the mobile radio network via the radio unit anyway so that further memory elements can be dispensed with. Further, by default, the SIM comprises authentication data which are required for the authentication of the SIM at the mobile radio service provider. These authentication data can also be used for authenticating the cash cassette at the service unit so that no further authentication data are required. Alternatively, for authentication at the service unit also other authentication data can be used. In addition, the use of a SIM is advantageous as SIMs can be obtained in a cost-efficient manner.

Further, it is advantageous when a telephone number is unambiguously assigned to the cash cassette by means of the SIM. This telephone number can in particular be used by the service unit for identifying the cash cassette and is in particular a part of the authentication data transmitted to the service unit.

On the SIM, application data for encrypting and/or signing data to be sent to the service unit and/or for decrypting and/or verifying the signature of data received by the service unit can be stored. By encrypting and/or signing the data, the transmission security is increased and the use of the sent data by unauthorized people is prevented or, respectively, made more difficult.

The device is preferably connected to a computer network of the operator of the device via a cable-based and/or a cable-free network connection, by which the operator of the device can monitor the status of the device, for example the stock of the cash cassettes accommodated in the device. The data transmission via the radio unit from the device to the service unit and/or from the service unit to the device takes place separately and independently of this network connection. Thus, a complete separation from the computer network of the operator is achieved so that, for stock management of the cash cassettes, the service unit does not have to fall back on the computer network of the operator and thus complex data protection systems such as firewalls are not necessary.

The radio unit preferably transmits the stock data to the service unit when it has received inquiry data from the service unit first. In this way, it is achieved that the service unit can query the stock data anytime they are needed so that a continuous monitoring of the stock of the cash cassette is possible.

In a preferred embodiment of the invention, the radio unit only sends data to the service unit when the radio unit has received authentication data for the unambiguous authentication of the service unit from the service unit. In this way, it is achieved that it is guaranteed that the stock data are only transmitted to the authorized service unit and cannot be queried by arbitrary mobile radio subscribers. In a particularly preferred embodiment of the invention the authentication data, via which the radio unit authenticates the service unit, comprise a telephone number of the service unit. In addition to the telephone number, in particular a PIN and/or a password are transmitted via which the authentication takes place. Alternatively, a list of telephone numbers of the service unit can be stored in the radio unit, and the radio unit can only accept calls from these telephone numbers. Further, for authentication of the service unit also the authentication data can be used that are needed by the service unit to log in and to authenticate itself at the mobile radio service provider. For this, the service unit preferably likewise comprises a SIM.

For transmitting the inquiry data, the service unit preferably calls the telephone number of the cash cassette of which the stock data are to be queried. This cash cassette transmits the stock data to the service unit after the service unit has been authenticated. In a preferred embodiment of the invention, the cash cassette interrupts the mobile radio connection established between the cash cassette and the service unit after it has received the inquiry data and calls the service unit back for transmitting the stock data. In this way, the security of the data transmission is increased because it is guaranteed that by means of the call back the radio unit transmits the data only to that service unit whose telephone number is stored for example in a memory area of the SIM of the cash cassette.

The radio unit in particular comprises a mobile phone for sending and receiving the data. In this way, a simple and cost-efficient structure of the radio unit is achieved.

In a preferred embodiment of the invention, at least two cash cassettes are accommodated in the safe, wherein each cash cassette comprises an authentication data memory in which authentication data for the unambiguous authentication of the cash cassette by the service unit are stored. Further, each cash cassette comprises a stock data memory in which stock data with information on a current stock of notes of value in the respective cash cassette are stored. In a particularly preferred embodiment of the invention, the device comprises four cash cassettes. By providing several cash cassettes, on the one hand, the time interval is increased within which the cash cassettes have to be emptied or, respectively, filled. On the other hand, in this way a type-specific storage of the notes of value in the cash cassettes is made possible since for banknotes of different denominations one own cash cassette each can be provided.

When several cash cassettes are accommodated in the safe, it is advantageous when each cash cassette is connected in a periodically recurring manner for a preset time interval to the radio unit via a data line so that within this time interval the mobile radio connection between the respective cash cassette and the service unit can be established and the authentication data and/or the stock data can be transmitted. Further, within this time interval the cash cassette can receive the inquiry data from the service unit. In this way, it is achieved that of each cash cassette accommodated in the safe data can be transmitted to the service unit although the device only has one radio unit. The preset time interval is in particular the same for each cash cassette. Alternatively, the time interval can also be set differently dependent on the experienced frequency in which the cash cassettes for a specific denomination have to be emptied or, respectively, filled.

In an alternative embodiment of the invention, the device, too, can comprise a SIM via which a telephone number is unambiguously assigned to the device. Further, all cash cassettes accommodated in the safe of the device each comprise a SIM via which one telephone number each is unambiguously assigned to the respective cash cassette. For each of these telephone numbers, a call forwarding to the telephone number of the device is set up. For querying the stock of a cash cassette, the service unit sends the inquiry data to the telephone number of the cash cassette. The inquiry data are forwarded via the call forwarding and are received by the radio unit. Thereupon, the radio unit connects itself via a data line to the cash cassette to which inquiry data were directed, and transmits the authentication data and/or the stock data of this cash cassette to the service unit. By this embodiment of the invention it is achieved that all cash cassettes accommodated in the safe of the device can be contacted at any time by the service unit and the stock of all cash cassettes accommodated in the device can be queried at any time. Thus, no time intervals have to be taken into account.

The service unit is preferably integrated into a service center of a service provider in charge of the filling and emptying of the cash cassette, which service center is remote from the device. The service unit is in particular a part of a data processing system of a valuable transport company.

In a preferred embodiment of the invention, the device comprises an authentication data memory in which authentication data for the unambiguous authentication of the device are stored. Further, the device comprises a maintenance data memory in which maintenance data are stored. The radio unit transmits the authentication data and the maintenance data to a service unit via mobile radio. The maintenance data in particular comprise information on malfunctions of the device, information of fault storages, logging files, values of preset parameters and/or current values of parameters. By transmitting the maintenance data via mobile radio by means of the radio unit, a remote maintenance of the device by the service unit is achieved. Since the transmission of the maintenance data by the radio unit takes place independently of the computer network of the operator of the device into which the device is integrated, the service unit has no access to the computer network of the operator so that for the data exchange with the service provider the operator does not have to protect its computer network via complex systems, such as firewalls. Thus, an easy and cost-efficient remote maintenance is made possible.

In a particularly preferred embodiment of the invention, the radio unit receives from the service unit data sent via mobile radio with at least one setting value to be preset and/or at least one instruction to be executed. In this way, in particular malfunctions are removed. Thus, the removal of malfunctions can take place without the company in charge of the maintenance having to send employees to the location of the device. The service unit is in particular integrated into a service center of a service provider in charge of the maintenance of the device. The service unit for maintaining the device and the service unit for filling and emptying the cash cassettes can be identical. Alternatively, the service units can also be different units.

Additionally or alternatively to the maintenance data memory, the device can comprise a control unit for controlling the device, which executes program data of a computer program. The control unit reads out the authentication data stored in the authentication data memory of the device and generates an unambiguous reference value. The radio unit transmits reference data for generating a device-individual license key to a license management unit via mobile radio, the reference data comprising the reference value. Further, the radio unit receives data comprising the license key from the license management unit, and the control unit enables at least one function module of the computer program dependent on this license key. In this way, a simple licensing procedure is obtained for the computer program to be executed by the control unit. The license granting and the license management can take place exclusively via the mobile radio connection so that it is not necessary that employees of the licensor drive to the location of the device for licensing. By transmitting the reference data and the data comprising the license key via the mobile radio connection no access to the computer network of the operator into which the device is integrated is required so that security measures against accesses of the licensor to data for which he has no authorization are not required either. Further, the licensor can provide updates for the computer program via the mobile radio connection between the license management unit and the radio unit and the updates can, for example, be installed and/or serviced by means of remote maintenance.

A further aspect of the invention relates to a cash cassette for holding notes of value. The cash cassette comprises a radio unit for sending data from the cash cassette to a service unit via mobile radio and/or for receiving data sent by the service unit via mobile radio. Further, the cash cassette has a memory element in which authentication data for the unambiguous authentication of the cash cassette are stored. The radio unit transmits the authentication data and stock data with information on the current stock of notes of value in the cash cassette to the service unit via mobile radio. In this way, it is achieved that the cash cassette can transmit the stock data by itself to the service unit independent of a device and/or can directly be contacted by the service unit via mobile radio. In this way, the stock data can be queried by the service unit at any time even if the cash cassette is at present not accommodated in an automated teller machine, an automatic cash register system and/or an automatic cash safe.

The cash cassette in particular comprises a SIM that comprises a storage area in which the authentication data are stored. Both the radio unit and the storage element or, respectively, the SIM can be developed in the same manner as previously specified for the radio unit, the stock data memory or, respectively, the SIM of the device. In particular, the cash cassette can be developed with the features specified. Likewise, the authentication data and/or the stock data can have the same data structures as previously specified.

It is advantageous when in the case of a manipulation of the cash cassette or a manipulation attempt the radio unit sends data with an alarm message to the service unit. Thus, the cash cassette can immediately inform the service unit about a manipulation attempt or a manipulation so that the service unit can take countermeasures at once.

A further aspect of the invention relates to a device for handling notes of value, which comprises a safe in which at least one cash cassette, preferably several cash cassettes, of the afore-described design are accommodated. The device comprises a first radio unit arranged outside the safe and a second radio unit arranged within the safe. The first radio unit transmits data to a service unit via mobile radio and receives data from the service unit. The second radio unit sends data via mobile radio to the radio units of the cash cassettes accommodated in the safe and receives data from the radio units of these cash cassettes. The first radio unit and the second radio unit are connected to each other via a cable for transmitting data, wherein the first radio unit transmits the data received from the service unit via the data cable to the second radio unit which in turn sends these data to the cash cassette via mobile radio. In contrast thereto, the second radio unit receives the data sent from the cash cassette and transmits these data via the data cable to the first service unit which in turn transmits these data to the service unit via mobile radio. In this way, it is achieved that despite the shielding effect of the safe a secure mobile radio connection between the service unit and the radio units of the cash cassettes which are accommodated in the safe is guaranteed so that the stock data can be transmitted reliably at any time. In an alternative embodiment of the invention, the device can also comprise no radio unit and the safe can be designed such that the radio units of the cash cassettes accommodated in the safe can directly send data to the service unit or, respectively, can receive data from the service unit.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
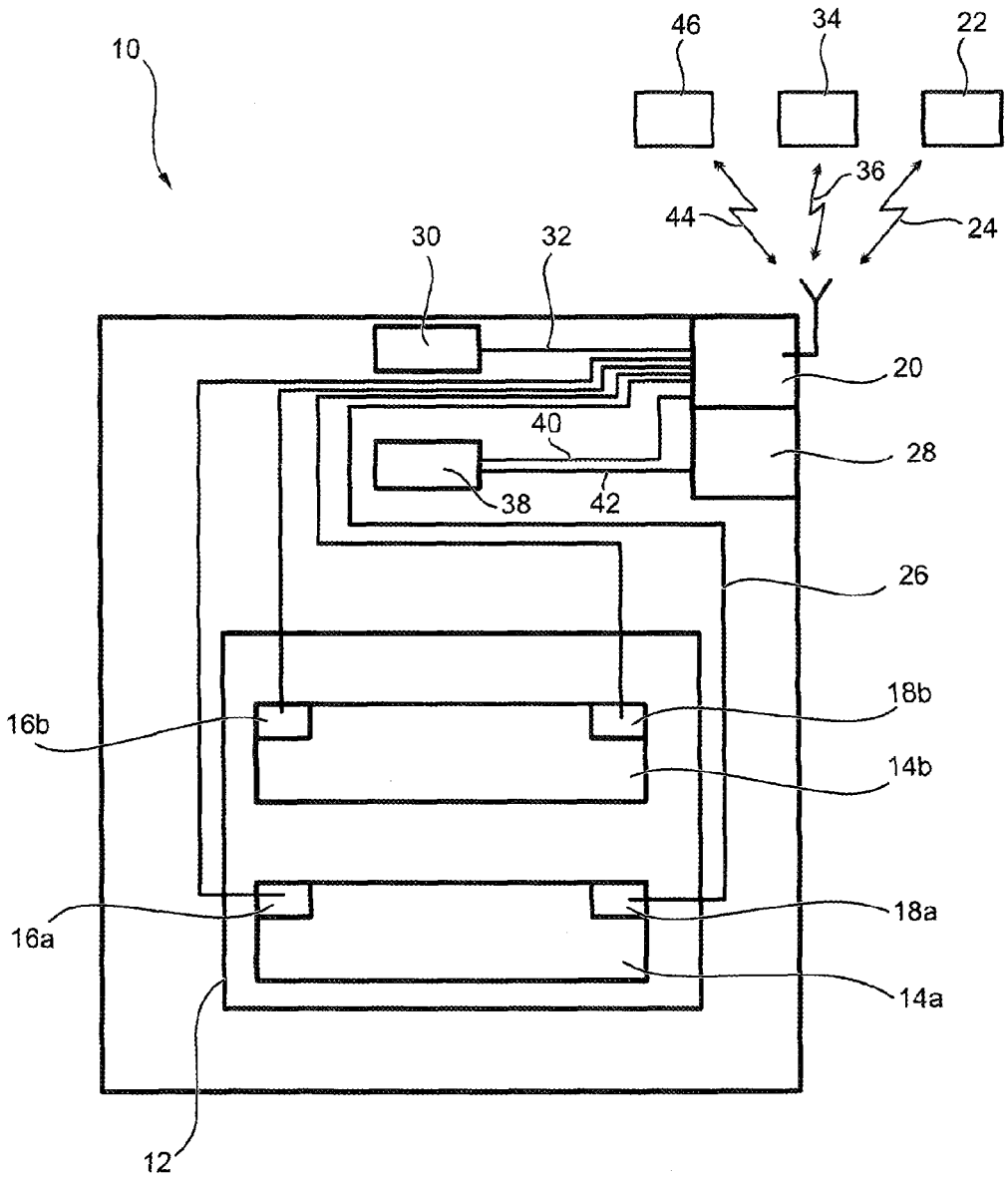
FIG. 1 shows a schematic illustration of a device for handling notes of value according to a first embodiment of the invention.

In FIG. 1, a schematic illustration of a device 10 for handling notes of value according to a first embodiment of the invention is shown. In this embodiment, the device 10 is an automated teller machine. Alternatively, the device 10 can also be an automatic cash register system or an automatic cash safe.

The automated teller machine 10 comprises a safe 12 in which two cash cassettes 14*a*, 14*b* are accommodated. By means of the safe 12, the cash cassettes 14*a*, 14*b* are protected against unauthorized access. In an alternative embodiment, the automated teller machine 10 can also only comprise one cash cassette 14*a*, 14*b* or more than two cash cassettes 14*a*, 14*b*. The cash cassettes 14*a*, 14*b* are connected via a non-illustrated transport path to a likewise not illustrated input and output module for depositing and/or withdrawing notes of value.

The two cash cassettes 14*a*, 14*b* each comprise a stock data memory 16*a*, 16*b* and a subscriber identity module (SIM) 18*a*, 18*b*. In each stock data memory 16*a*, 16*b*, stock data with information on the current stock of notes of value in the respective cash cassette 14*a*, 14*b* are stored. Preferably, the serial number, the order, the denomination or the currency of all notes of value held in the respective cash cassette 14*a*, 14*b* are stored in the stock data memory 16*a*, 16*b*, whereby a closed money circuit, a so-called cash cycle management of the second order, is made possible because the current stock of the cash cassettes 14*a*, 14*b* is known at any time. In this way, the cash cassettes 14*a*, 14*b* can be exchanged between different automated teller machines 10 without a revision having to be carried out first.

Further, the automatic teller machine 10 comprises a radio unit 20 for sending data to a stock service unit 22 and for receiving data from this stock service unit 22 via mobile radio. The receiving and sending of data via mobile radio is indicated by the double arrow 24. The SIMs 18*a*, 18*b* of the cash cassettes 14*a*, 14*b* each comprise a memory area in which authentication data for the unambiguous authentication of the cash cassettes 14*a*, 14*b* by the stock service unit 22 are stored. Via these authentication data, the individual cash cassettes 14*a*, 14*b* can be unambiguously identified and authenticated by the stock service unit 22. Both the SIMs 18*a*, 18*b* of the cash cassettes 14*a*, 14*b* and the stock data memories 16*a*, 16*b* are connected to the radio unit 20. The SIMs 18*a*, 18*b* and the stock data memories 16*a*, 16*b* are preferably connected to the radio unit 20 via data cables for data transmission. One of these data cables is exemplarily identified with the reference sign 26. Alternatively, the SIMs 18*a*, 18*b* and/or the stock data memories 16*a*, 16*b* can also be connected to the radio unit 20 via a cable-free data connection.

The radio unit 20 sends stock data with information on the current stock of notes of value in the cash cassettes 14*a*, 14*b* and the authentication data stored in the SIMs 18*a*, 18*b* via mobile radio 24 to the stock service unit 22. In this way, the stock service unit can monitor the stock of notes of value in the cash cassettes 14*a*, 14*b* at any time. When the stock in a cash cassette 14*a*, 14*b* exceeds an upper limit value or when the stock in a cash cassette 14*a*, 14*b* falls below a lower limit value, then the stock service unit 22 causes that the respective cash cassette 14*a*, 14*b* is filled with notes of value or, respectively, emptied. In this way, it is guaranteed that the cash cassettes 14*a*, 14*b* are emptied or, respectively, filled in time so that there will be no down times of the automated teller machine 10 and a customer using the automated teller machine 10 is paid out a desired amount of money at any time and/or can deposit a desired amount of money at any time.

The stock service unit 22 is in particular integrated into a service center, preferably a data processing system, of a service company in charge of the stock management of the automated teller machine 10. The service company is in particular a valuable transport company which is in charge of a plurality of automated teller machines 10, automatic cash register systems and/or automatic cash safes and which distributes notes of value to be paid out from these or, respectively, notes of value deposited therein, in particular in the form of a closed money circuit, between the individual automated teller machines 10, automatic cash register systems and/or automatic cash safes and a cash center. The stock service unit 22 is in particular arranged remotely from the automated teller machine 10.

The points in time at which the stocks in the cash cassettes 14*a*, 14*b* are transmitted to the stock service unit 22 via mobile radio 24 can be specified in different ways.

In a first embodiment, the stock data of the individual cash cassettes 14*a*, 14*b* can be transmitted to the stock service unit 22 at preset periodically recurring time intervals. Here, the SIMs 18*a*, 18*b* of the cash cassettes 14*a*, 14*b* are connected to the radio unit 20 in accordance with these time intervals so that within this time interval the stock data of the cash cassette 14*a*, 14*b* connected to the radio unit 20 can be transmitted to the stock service unit 22.

In a second embodiment, the device 10 can comprise a non-illustrated control unit which compares the current stock of notes of value in the cash cassettes 14*a*, 14*b* with the upper and the lower limit value. When the current stock in a cash cassette 14*a*, 14*b* exceeds the upper limit value or when the current stock of a cash cassette 14*a*, 14*b* falls below the lower limit value then the stock data are sent to the stock service unit 22 via the radio unit 20. Alternatively, also each cash cassette 14*a*, 14*b* can comprise a control unit which compares the current stock with the upper and the lower limit value. The upper and the lower limit value can be differently preset for each cash cassette 14*a*, 14*b*.

In a further embodiment, the stock data can be transmitted to the stock service unit 22 when the stock service unit 22 has first transmitted inquiry data to the radio unit 20 of the automated teller machine 10. For this, the SIMs 18*a*, 18*b* of the cash cassettes 14*a*, 14*b* can be alternatively connected to the radio unit 20 at periodically recurring time intervals. Only within the time interval within which the respective SIM 18*a*, 18*b* is connected with the radio unit 20, the stock service unit 22 can query the stock data of the respective cash cassette 14*a*, 14*b*.

For inquiry of the stock data, the stock service unit 22 can in particular call a telephone number that is unambiguously assigned to the respective cash cassette 14*a*, 14*b* via the respective SIM 18*a*, 18*b*. Alternatively, the automated teller machine 10 can also comprise a SIM 28 via which a telephone number is unambiguously assigned to the automated teller machine 10. For each telephone number of the cash cassettes 14*a*, 14*b*, a call forwarding to the telephone number of the automated teller machine 10 is set up, preferably automatically, so that the inquiry data which were sent to a telephone number of a cash cassette 14*a*, 14*b* are forwarded to the telephone number of the automated teller machine 10 and can be received by the automated teller machine 10 at any time. The radio unit 20 then transmits the stock data of the respective cash cassette 14*a*, 14*b* to the stock service unit 22.

Alternatively, the afore-described embodiments for defining the points in time at which the stock data are transmitted can also be combined with one another. In particular, the stock data can be transmitted at fixed points in time and can in addition be queried between the points in time by the stock service unit 22 if required.

The radio unit 20 only transmits data to the stock service unit 22 when it has first received authentication data for the unambiguous authentication of the stock service unit 22 by the stock service unit 22. In this way, it is guaranteed that the data can only be transmitted to an authorized stock service unit 22 and cannot be queried by any mobile radio subscriber.

Prior to their transmission, the data transmitted from the radio unit 20 to the stock service unit 22 are encrypted and/or signed by means of application data for encrypting and/or signing data that are stored on the SIM 28 of the automated teller machine 10 or the respective SIM 18*a*, 18*b* of the respective cash cassette 14*a*, 14*b*. In this way, a secure transmission is achieved so that the data cannot be used and/or manipulated by unauthorized mobile radio subscribers.

By authenticating the cash cassette 14*a*, 14*b* at the stock service unit 22 and by authenticating the stock service unit 22 at the automated teller machine 10, a two-way-authentication is achieved, as a result whereof it is guaranteed that the data are only transmitted between authorized units.

The stock data and the authentication data are transmitted successively, the authentication data being transmitted first and then the stock data being transmitted. Alternatively, the authentication data and the stock data can also be transmitted jointly. As authentication data in particular those authentication data can be used which are used on the SIM 18*a*, 18*b*, 28 for the authentication of the SIM 18*a*, 18*b*, 28 at the mobile radio service provider. Thus, no further authentication data for the authentication of the cash cassettes 14*a*, 14*b* or, respectively, of the automated teller machine 10 at the stock service unit 22 have to be stored on the SIM 18*a*, 18*b*, 28.

Further, the automated teller machine 10 comprises a maintenance memory 30 which is connected to the radio unit 20 via a data cable 32. In the maintenance data memory 30 maintenance data are stored. The maintenance data can in particular comprise information about malfunctions of the automated teller machine 10, data of fault storages, logging files, desired values of parameters of the automated teller machine 10 and/or actual values of parameters of the automated teller machine 10.

The SIM 28 of the automated teller machine 10 comprises a memory area in which authentication data for the unambiguous authentication of the automated teller machine 10 at a maintenance service unit 34 are stored. The radio unit 20 transmits the authentication data stored on the SIM 28 of the automated teller machine 10 and the maintenance data to the maintenance service unit 34 via mobile radio 36. The authentication of the automated teller machine 10 at the maintenance service unit 34 can take place in the same manner as previously described for the authentication of the cash cassettes 14*a*, 14*b* at the stock service unit 22. By transmitting the maintenance data via mobile radio 36 a remote maintenance of the automated teller machine 20 is made possible in an easy manner. The radio unit 20 transmits the maintenance data to the maintenance service unit 34 at preset time intervals, for example daily at midnight.

In an alternative embodiment, the maintenance data can also be transmitted to the maintenance service unit 34 when at least one piece of information contained in the maintenance data has changed, in particular when there is a malfunction of the automated teller machine 10. In this way, it is achieved that the maintenance service unit 34 is informed about the presence of a malfunction immediately after the occurrence of a malfunction so that the malfunction can be removed as soon as possible. For removal of the malfunction, the maintenance service unit 34 sends via mobile radio 36 data with at least one setting value to be preset and/or at least one instruction to be executed, via which the present malfunction is to be removed. Alternatively, the radio connection can also only be established unidirectionally between the radio unit 20 and the maintenance service unit 34, i.e. the radio unit 20 can indeed send data to the maintenance service unit 34 but cannot receive any data from the maintenance service unit 34. In this case, malfunctions have to be removed on site by an employee of the maintenance service company. The maintenance service unit 34 is in particular integrated into a data processing system of a maintenance service company. The maintenance service unit 34 and the stock service unit 22 can be identical or separate units.

The data transmitted between the radio unit 20 and the maintenance unit 34 are, as already previously described for the data transmitted between the radio unit 20 and the stock service unit 22, encrypted and/or signed. The radio unit 20 preferably only transmits data to the maintenance service unit 34 and/or only sets the transmitted setting values or, respectively, only executes the received instructions when it has first received authentication data for the unambiguous authentication of the maintenance service unit 34 from the maintenance service unit 34.

Further, the automated teller machine 10 comprises a control unit 38 which is connected to the radio unit 20 and the SIM 28 of the automated teller machine 10 via data cables 40, 42. The control unit 38 executes program data of a computer program for the control of the automated teller machine 10. For the licensing of this computer program or of modules of the computer program the control unit 38 reads out the authentication data which are stored in the SIM 28 and generates a reference value dependent on these authentication data. The radio unit 20 then sends via mobile radio 44 reference data which comprise the reference value to a license management unit 46. The license management unit 46 generates dependent on the reference data and the function modules booked by the licensee, in particular the operator of the automated teller machine 10, a license key and sends data comprising the license key via mobile radio 44 to the radio unit 20. The control unit 38 then enables the function modules of the computer program purchased by the licensee dependent on the license key. The reference data in particular comprise the reference value, information about the licensee and/or order information.

The license management unit is in particular integrated into a data processing system of the licensor. The licensor is in particular the manufacturer of the computer program whose program data are executed by the control unit 38.

In this way, an easy licensing method for licensing the computer program is achieved. In particular, the licensing of the computer program can take place without data having to be manually installed on the automated teller machine 10. The computer program with all its function modules is in particular factory-preinstalled on the automated teller machine 10 or is completely installed upon start-up of the automated teller machine 10. The modules purchased by the licensee are then enabled by the licensing. On each automated teller machine 10, the same computer program or, dependent on which function modules have been purchased by the operator of the automated teller machine 10, a different computer program can be factory-preinstalled. This reduces the expenses. The reference data are in particular transmitted from the automated teller machine 10 to the license management unit 46 when the automated teller machine 10 is put into operation for the first time.

The data transmission between the automated teller machine 10 and the license management unit 46 only takes place when the license management unit 46 has authenticated itself at the automated teller machine 10 by sending authentication data and/or when the automated teller machine 10 has authenticated itself at the license management unit 46 by sending the authentication data stored on the SIM 28. As already described, the data transmitted between the license management unit 46 and the automated teller machine 10 are encrypted and/or signed. For this, likewise application data preferably stored in a memory area of the SIM 28 are used.

The automated teller machine 10 is in particular integrated into a computer network of the operator, into which several automated teller machines, automatic cash register systems and/or automatic cash safes are integrated and via which the operator can retrieve and/or manage current information about the automated teller machines, automatic cash register systems and/or automated cash safes at any time. By transmitting the stock data, the maintenance data and the reference data via mobile radio 24, 36, 44 to the stock service unit 22, the maintenance service unit 34 or, respectively, the license management unit 46 it is achieved that the stock service unit 22, the maintenance service unit 34 and the license management unit 46 do not require access to this computer network. In this way, data security within the computer network of the operator is increased because there is no access from outside. In particular, in this way, cost-efficient and complex firewalls can be dispensed with. On the other hand, the service units 22, 34 and the license management unit 46 need not be configured on different network structures at different operators of automated teller machines, automatic cash register systems and/or automatic cash safes.

In an alternative embodiment of the invention, the authentication data need not be stored in the respective SIM 18*a*, 18*b*, 28 but can stored in separate authentication data memories. Further, alternatively, the stock service unit 22 and the maintenance service unit 34 can be the same service unit, in particular when the service company in charge of the stock management and the service company in charge of the maintenance are the same service company.

The maintenance of the automated teller machine 10 is in particular carried out by the manufacturer of the automated teller machine 10. The license management unit 46 is in particular integrated into a service center of the manufacturer of the computer program whose program data are executed by the control unit 38. In this case, updates of the computer program can be transmitted from the license management unit 46 via mobile radio 44 to the radio unit 20. In this way, it is achieved that the updates do not have to be installed on the automated teller machine 10 manually on site, but can be transmitted and installed cost-efficiently, quickly and easily by means of mobile radio 44. The updates in particular comprise so-called hotfixes and/or security patches.

In an alternative embodiment of the invention, also only the stock management and the maintenance of the automated teller machine 10 can be carried out via mobile radio. Likewise, alternatively, also only the stock management and the license management can be carried out via mobile radio.

Figure 2:
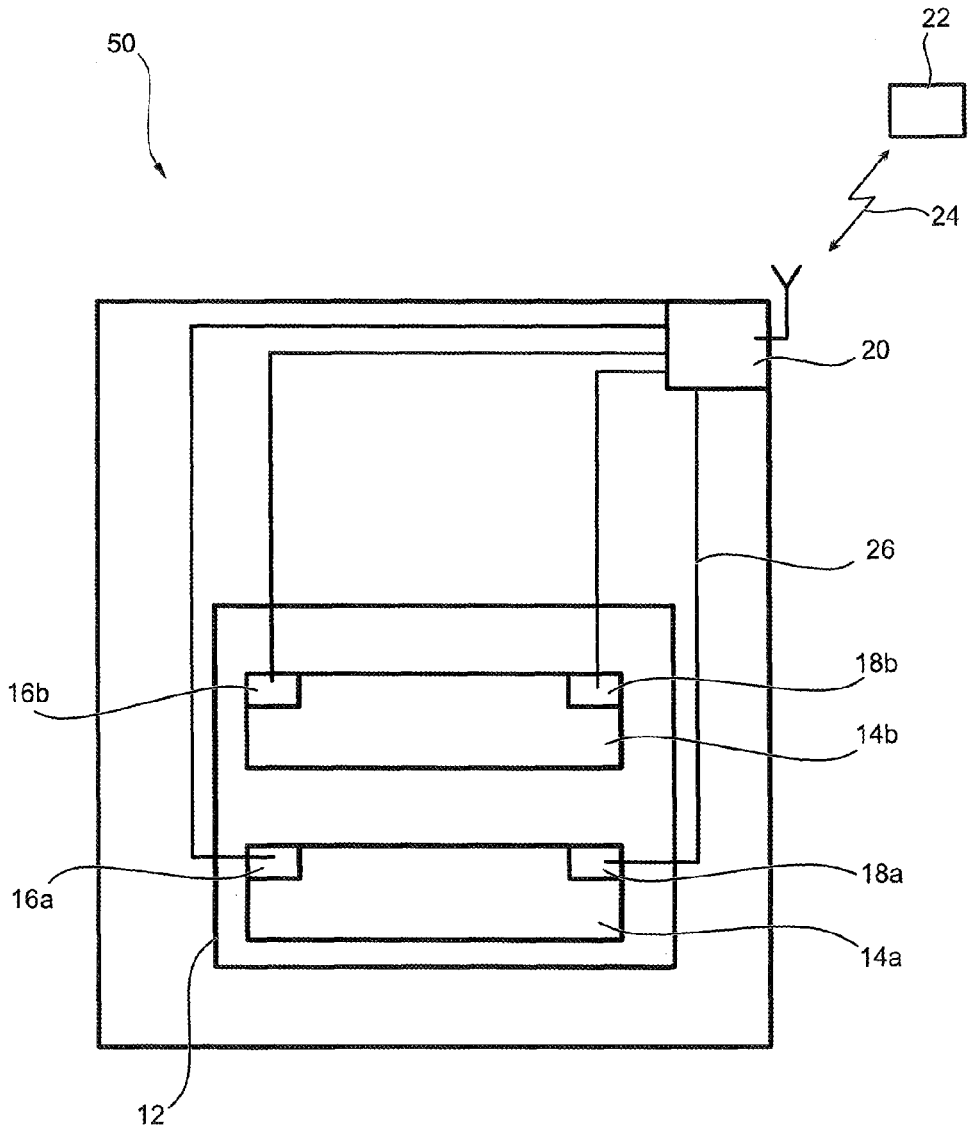
FIG. 2 shows a schematic illustration of a device for handling notes of value according to a second embodiment of the invention.

In FIG. 2, a schematic illustration of a device 50 for handling notes of value according to a second embodiment of the invention is shown. Elements having the same structure or the same function are identified with the same reference signs.

In this second embodiment of the invention, only the stock management of the device 50 is carried out via mobile radio 24. The device 50 thus comprises no own SIM 28, as in the case of the automated teller machine 10 according to FIG. 1.

Figure 3:
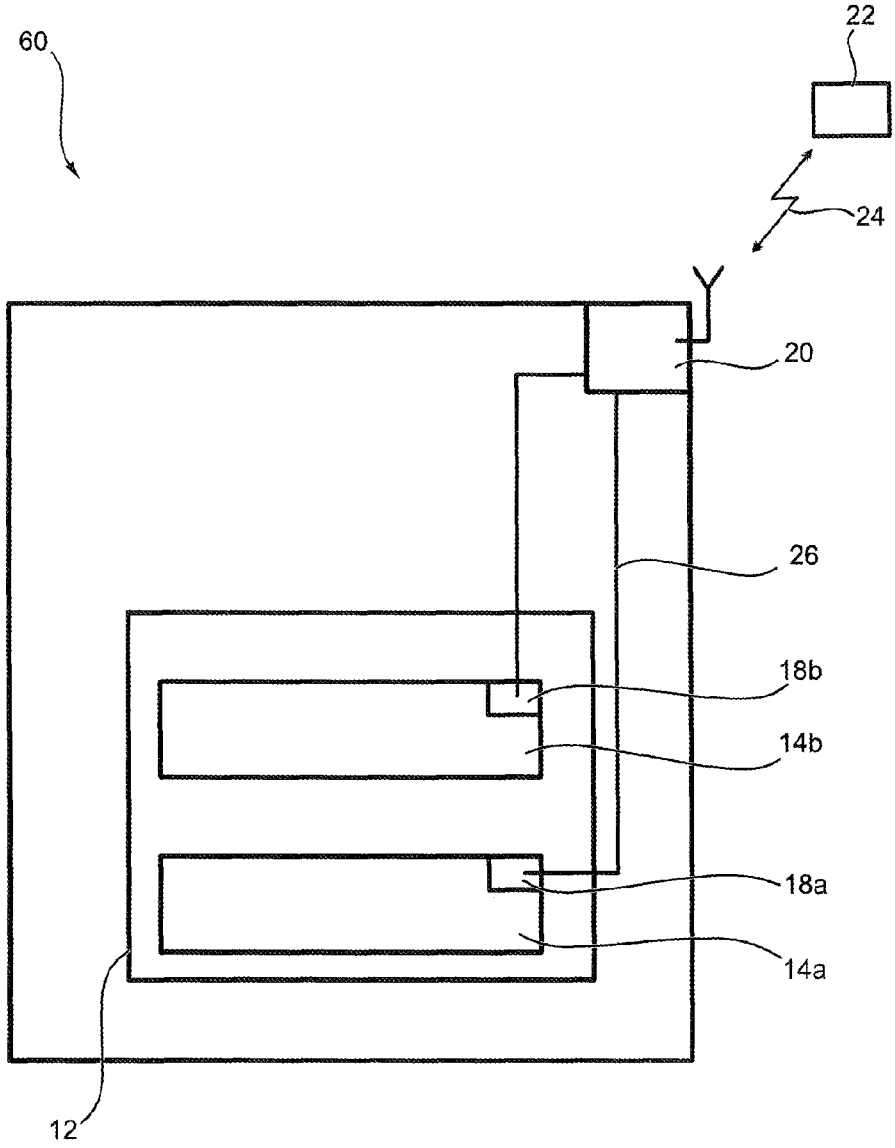
FIG. 3 shows a schematic illustration of a device for handling notes of value according to a third embodiment of the invention.

In FIG. 3, a schematic perspective illustration of a device 60 for handling notes of value according to a third embodiment of the invention is shown. In this embodiment, the cash cassettes 14*a*, 14*b* each comprise only one SIM 18*a*, 18*b* but no stock data memory 16*a*, 16*b*. In this embodiment, the stock data are likewise stored in a memory area of the respective SIM 18*a*, 18*b*. As a result thereof, additional stock data memory 16*a*, 16*b* is saved.

Figure 4:
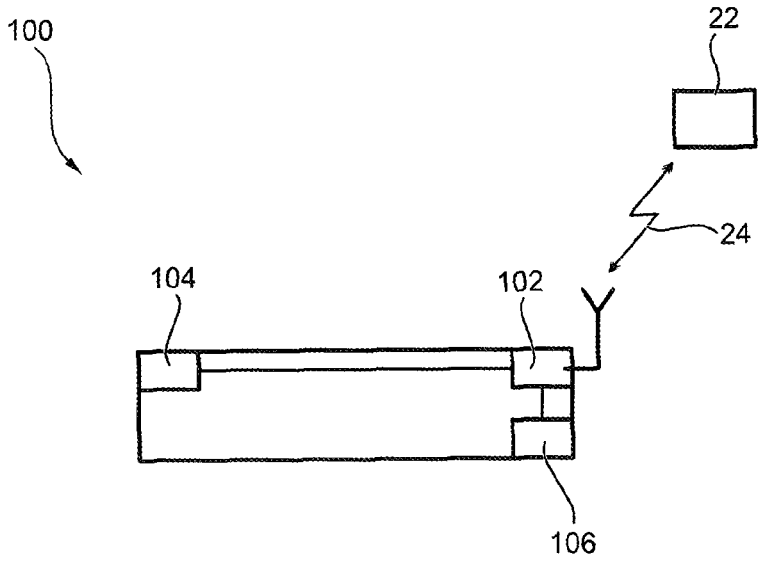
FIG. 4 shows a schematic illustration of a cash cassette.

In FIG. 4, a schematic illustration of a cash cassette 100 for holding notes of value is shown. The cash cassette 100 comprises a radio unit 102 for sending data via mobile radio 24 to the stock service unit 22 and for receiving data sent by the stock service unit 22 via mobile radio 24.

Further, the cash cassette 100 has a stock data memory 104 on which the stock data are stored. In addition, the cash cassette 100 comprises a SIM 106 on which the authentication data are stored for the unambiguous authentication of the cash cassette 100. Alternatively, the stock data can also be stored in a memory area of the SIM 106. In this case, no separate stock data memory 104 is required.

As the cash cassette 100, in contrast to the cash cassettes 14*a*, 14*b* shown in FIGS. 1 to 3, comprises an own radio unit 102, the cash cassette 100 can communicate with the stock service unit 22 independently of a device 10, 50, 60 for handling notes of value. In this way, the stock data of the cash cassette 100 can be transmitted to the stock service unit 22 at any time, even if the cash cassette 100 is not accommodated in a device 10, 50, 60. The transmission of the data between the cash cassette 100 and the stock service unit 22 in particular takes place in the same manner as previously described for the data transmission between the radio unit 20 of the device 10, 50, 60 for handling notes of value and the stock service unit 22. In particular, the transmitted data are encrypted and/or signed and preferably a two-way-authentication between the cash cassette 100 and the stock service unit 22 takes place.

Further, by providing a radio unit 102 in the cash cassette 100 the location where the cash cassette 100 is located can be determined at least approximately at any time. The radio unit 102 has to log itself on at a mobile radio service provider for sending and receiving data via mobile radio. On this occasion, it is determined in which radio cell the cash cassette 100 is located, as a result whereof the approximate location of the cash cassette 100 can be determined.

In a preferred embodiment of the invention, the cash cassette 100 comprises at least one sensor, not illustrated in FIG. 4, for detecting manipulations or, respectively, manipulation attempts of the cash cassette 100. The cash cassette 100 sends alarm data via mobile radio 24 to the stock service unit 22 when a manipulation attempt or a manipulation of the cash cassette 100 has been detected by means of the sensor. In this way, it is achieved that the stock service unit 22 immediately learns about a manipulation attempt or, respectively, a manipulation so that measures can be taken as soon as possible. By a manipulation or, respectively, a manipulation attempt in particular the unauthorized opening of the cash cassette 100 is understood.

Figure 5:
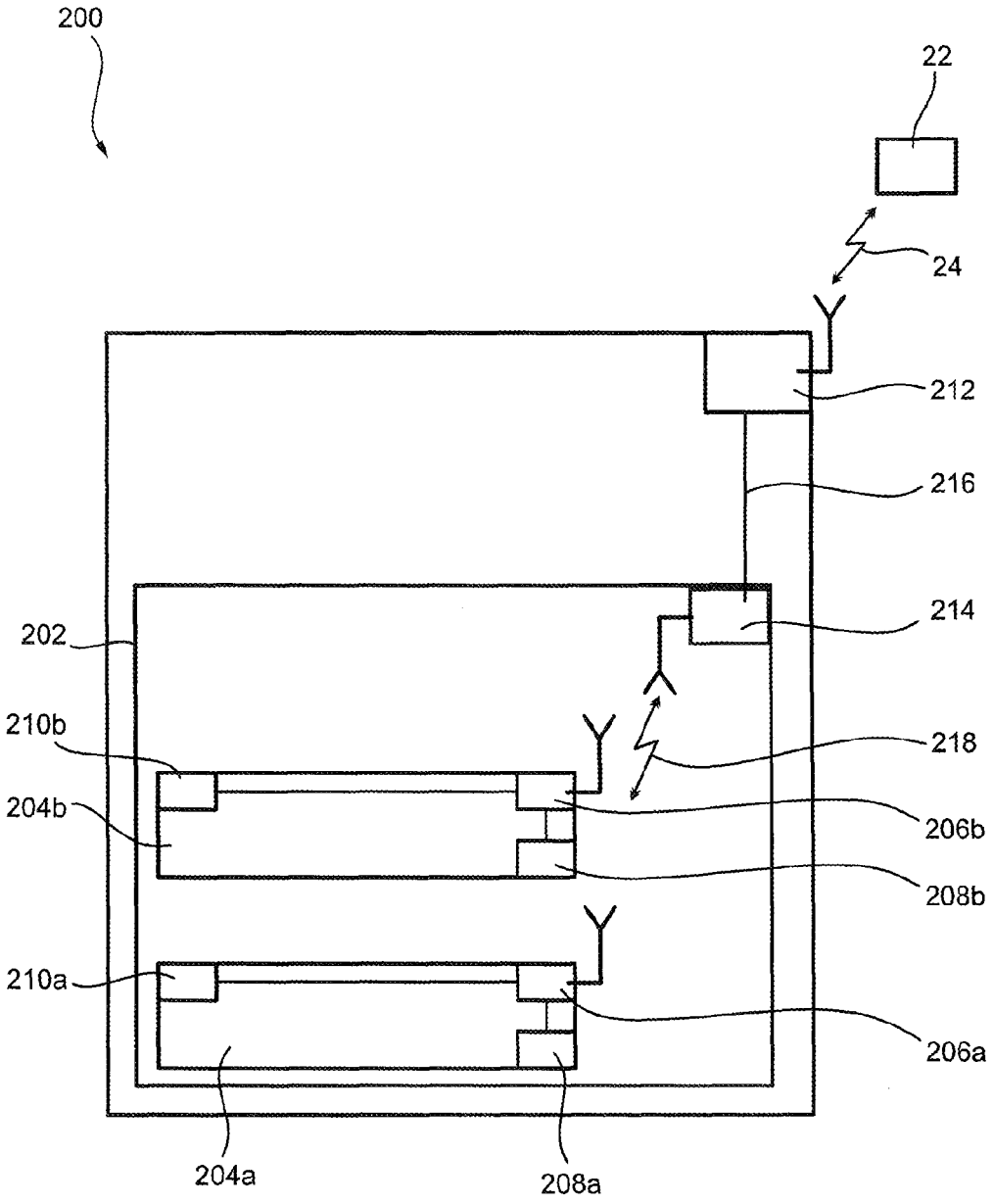
FIG. 5 shows a schematic illustration of a device for handling notes of value according to a fourth embodiment of the invention.

In FIG. 5, a schematic illustration of a device 200 for handling notes of value according to a fourth embodiment of the invention is shown. The device 200 comprises a safe 202 in which two cash cassettes 204*a*, 204*b* are accommodated. The cash cassettes 204*a*, 204*b* are designed in accordance with the cash cassette 100 of FIG. 4 and each comprise a radio unit 206*a*, 206*b*, a SIM 208*a*, 208*b* and a stock data memory 210*a*, 210*b*.

Further, the device 200 has a first radio unit 212 arranged outside the safe 202 and a second radio unit 214 arranged within the safe 202. The first radio unit 212 and the second radio unit 214 are connected to each other via a data connection 216, in particular a data cable 216.

The first radio unit 212 receives the data sent from the stock service unit 22 via mobile radio 24 and transmits these received data via the data cable 216 to the second radio unit 214. The second radio unit 214 in turn sends the data received via the data cable 216 to the safe 202 via mobile radio 218. Subsequently, these data are received by the radio unit 206*a*, 206*b* of the cash cassette 204*a*, 204*b* to which the data were sent.

In contrast thereto, the data sent by the radio units 206*a*, 206*b* of the cash cassettes 204*a*, 204*b* are received by the second radio unit 214 and transmitted to the first radio unit 212 via the data cable 216 and transmitted from the first radio unit 212 via mobile radio 24 further to the stock service unit 22.

By providing two connected radio units 212, 214 it is achieved that the radio units 206*a*, 206*b* of the cash cassettes 204*a*, 204*b* can also receive data via mobile radio and send data via mobile radio when they are arranged within a safe 202. In particular, it is achieved in this way that the shielding of the mobile radio network effected by the safe 202 does not impair the quality of the data transmission between the cash cassettes 204*a*, 204*b* and the stock service unit 22.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for handling notes of value, comprising:

a radio unit for sending data from the device to a service unit via mobile radio, and a safe for accommodating cash cassettes, wherein at least one cash cassette is accommodated in the safe, the cash cassette includes an authentication data memory in which authentication data for the unambiguous authentication of the cash cassette by the service unit are stored, stock data with information on the current stock of notes of value in the cash cassette can be determined, and wherein the radio unit transmits the stock data and the authentication data to the service unit via mobile radio.

2. The device according to claim 1, wherein comprises a stock data memory in which at least the current stock of notes of value in the cash cassette, preferably the serial number, the order, the denomination and the currency of all notes of value contained in the cash cassette is stored, and from which the current stock is read out for determining the stock data, and/or a stock sensor for determining the current stock of notes of value in the cash cassette.

3. The device according to claim 1, wherein a control unit compares the current stock with an upper limit value and/or a lower limit value and in that the radio unit transmits the stock data to the service unit when the current stock exceeds the upper limit value or the current stock falls below the lower limit value.

4. The device according to claim 1, wherein the cash cassette comprises a subscriber identity module (SIM) with a memory area for storing the stock data and/or the authentication data.

5. The device according to claim 4, wherein a telephone number is unambiguously assigned to the cash cassette by means of the SIM.

6. The device according to claim 4, wherein application data for encrypting and/or signing data to be sent to the service unit and/or for decrypting and/or verifying the signature of data received by the service unit are stored on the SIM.

7. The device according to claim 1, wherein the device is integrated into a computer network of an operator of the device via a cable-based and/or a cable-free network connection, and in that the data transmission via the radio unit takes place separately and independently of the network connection.

8. The device according to claim 1, wherein the radio unit transmits the stock data to the service unit via mobile radio after the radio unit has received inquiry data from the service unit.

9. The device according to claim 8, wherein the cash cassette comprises a subscriber identity module (SIM) with a memory area for storing the stock data and/or the authentication data, via which a telephone number is unambiguously assigned to the cash cassette, and in that the service unit calls this telephone number for transmitting the inquiry data.

10. The device according to claim 1, wherein the radio unit only sends data to the service unit when it has received authentication data for the unambiguous authentication of the service unit from the service unit.

11. The device according to claim 1, wherein the radio unit comprises a mobile phone for sending and receiving mobile radio.

12. The device according to claim 1, wherein the device comprises an authentication data memory in which authentication data for the unambiguous authentication of the device are stored, in that the device comprises a maintenance data memory in which maintenance data are stored, and in that the radio unit transmits the authentication data and the maintenance data to a service unit via mobile radio.

13. The device according to claim 1, wherein the device comprises an authentication data memory in which authentication data for the unambiguous authentication of the device are stored, in that the device comprises a control unit for the control of the device, in that the control unit executes program data of a computer program, in that the control unit of the device reads out the authentication data stored in the authentication data memory of the device and generates an unambiguous reference value dependent on these authentication data, in that the radio unit transmits reference data for generating a device-individual license key to a license management unit, in that the reference data comprise the reference value, in that the radio unit receives data comprising the license key from the license management unit, and in that the control unit enables at least one function module of the computer program dependent on the license key.

14. A cash cassette for holding notes of value, comprising:

a radio unit for sending data from the cash cassette to a service unit via mobile radio and/or for receiving data sent by the service unit via mobile radio, and a memory element in which authentication data for the unambiguous authentication of the cash cassette are stored, wherein the radio unit transmits the authentication data and stock data with information on the current stock of notes of value in the cash cassette to the service unit via mobile radio.

15. The cash cassette according to claim 14, wherein in the case of a manipulation of the cash cassette or the attempt of a manipulation the radio unit sends data with an alarm message to the service unit via mobile radio.

16. A device for handling notes of value comprising:

a radio unit configured to send data from the device to a service unit by way of mobile radio;

a removable cash cassette including:

authentication data memory in which is stored authentication data configured to permit unambiguous authentication of the cash cassette by the service unit, the authentication data including at least one of a personal identification number (PIN) or password for authentication of the removable cash cassettes; and stock data memory in which is stored stock data including information regarding current of notes of value in the cash cassette;

wherein the radio unit is configured to transmit the stock data and the authentication data to the service unit by way of mobile radio.

17. The device of claim 16, wherein the mobile radio is a wireless cellular network.

18. The device of claim 17, wherein the wireless cellular network includes a plurality of fixed-location transceivers.

19. The device of claim 17, wherein the radio unit is configured to transmit the stock data to the service unit by way of the wireless cellular network after the radio unit has received inquiry data from the service unit.

20. The device of claim 19, wherein the authentication data memory includes a wireless cellular telephone number; and wherein the service unit transmits the inquiry data over the wireless cellular network by calling the wireless cellular telephone number.

* * * * *